US010174435B2

(12) United States Patent
Kerner

(10) Patent No.: US 10,174,435 B2
(45) Date of Patent: Jan. 8, 2019

(54) SYSTEM AND METHOD FOR SELECTIVE PLATING OF INTERIOR SURFACE OF ELONGATED ARTICLES

(71) Applicant: Tri-Star Technologies, El Segundo, CA (US)

(72) Inventor: Alex Aron Kerner, Pacific Palisades, CA (US)

(73) Assignee: Tri-Star Technologies, Los Angeles, CA (US)

( * ) Notice: Subject to any disclaimer, the term of this patent is extended or adjusted under 35 U.S.C. 154(b) by 53 days.

(21) Appl. No.: 15/017,428

(22) Filed: Feb. 5, 2016

(65) Prior Publication Data

US 2016/0230300 A1 Aug. 11, 2016

Related U.S. Application Data

(60) Provisional application No. 62/112,580, filed on Feb. 5, 2015.

(51) Int. Cl.

| | |
|---|---|
| ***C25D 5/02*** | (2006.01) |
| ***C25D 7/04*** | (2006.01) |
| ***C25D 17/06*** | (2006.01) |
| ***H01R 43/16*** | (2006.01) |

(52) U.S. Cl.

CPC ..... *C25D 7/04* (2013.01); *C25D 5/028* (2013.01); *C25D 17/06* (2013.01); *H01R 43/16* (2013.01)

(58) Field of Classification Search

CPC ..... C25D 7/04; C25D 17/06; C25D 5/028; H01R 43/16

See application file for complete search history.

(56) References Cited

U.S. PATENT DOCUMENTS

| | | | | |
|---|---|---|---|---|
| 4,077,852 | A | 5/1978 | Koontz et al. | |
| 4,280,882 | A * | 7/1981 | Hovey | C25D 5/02 204/DIG. 7 |
| 4,473,445 | A | 9/1984 | Smith et al. | |
| 4,555,321 | A | 11/1985 | Wicks | |
| 4,853,099 | A | 8/1989 | Smith | |
| 5,372,700 | A | 12/1994 | Pilorge et al. | |
| 7,842,170 | B1 | 11/2010 | von Detten | |

FOREIGN PATENT DOCUMENTS

EP 0070694 A1 1/1983

* cited by examiner

*Primary Examiner* — Louis J Rufo

(74) *Attorney, Agent, or Firm* — Lance M. Pritikin

(57) ABSTRACT

A multiplicity of sleeve subassemblies each include an electrically insulative portion, and are configured to support an electrical contact having a socket. Each insulative portion has a socket bore and at least one radial aperture extending radially outward therefrom. The sleeve subassemblies are transported across a plating bath whereby at least a lower segment of the insulative portions become submerged in plating solution. The socket bore maskingly engages the contact, thereby substantially preventing plating solution from contacting the outer surface of the socket. The radial apertures facilitate the continuous flow of plating solution through each socket so as to enable selective plating of the socket inner surface. The sleeve subassemblies may be formed from mutually-engageable half-sleeves conveyed on separate closed-loop transport belts so as to facilitate efficient loading, plating and release of the electrical contacts. The radial apertures may take on various forms, including holes, circumferential slits or vertical slits.

12 Claims, 6 Drawing Sheets

-- PRIOR ART --

SYSTEM AND METHOD FOR SELECTIVE PLATING OF INTERIOR SURFACE OF ELONGATED ARTICLES

RELATED APPLICATIONS

This application claims the benefit of U.S. Provisional Application No. 62/112,580 filed Feb. 5, 2015, the content of which is incorporated by this reference in its entirety for all purposes as if fully set forth herein.

TECHNICAL FIELD

The present invention relates generally to the field of plating electrical contacts. More particularly, the invention relates to selective plating of the interiors of female electrical contacts.

BACKGROUND

Electrical contacts, such a military-style "screw machined" contacts, are typically gold plated. In order to save gold, so-call "selective plating" methods may be used in which a whole contact is plated with a very thin layer of gold in conventional plating drums, and then selective plating (e.g., adding gold as-needed) is used in specific portions of the contact such as a tip of a small contact or an interior of a female contact. A thicker layer of gold may be needed on portions of the contact where the most stressful contact between mating parts exists. It is currently a known production challenge to limit the application of gold plating (original or subsequent) to the interior of a female electrical contact.

With regard to female electrical contacts, it may be particularly desirable to apply additional plating material only the interior surface in order to minimize waste of expensive plating material such as gold, platinum and the like. Numerous prior expedients have been proposed to facilitate selective plating of articles, including those expedients described in U.S. Pat. Nos. 4,077,852, 4,280,882, 4,853,099,5,372,700, 4,555,321, 7,842,170, 4,473,445 and European Patent Application No. EP0070694.

Many of the prior expedients rely primarily on such techniques as injecting plating solution into the socket and sucking it back out, using chromate films for masking purposes, using Teflon enclosures around the electrical contact in order to create a negative capillarity which prevents wetting of the exterior of the contact with plating solution, or using cells with a matching contour for masking the exterior surface of the contact. Each of these prior expedients is deficient in one or more aspects, such as their reliability, efficiency or results.

What is needed is an improved system and method for selectively plating the interior surface of an elongated articles (such as female electrical contacts or "sockets") in a manner which results in uniform plating, minimizes access of the plating solution to the exterior of the articles, and is more cost-effective than the prior expedients.

SUMMARY

Certain deficiencies of the prior art may be overcome by the provision of a system and method for selective plating of the interior surface of elongated articles, embodiments of which are disclosed herein.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
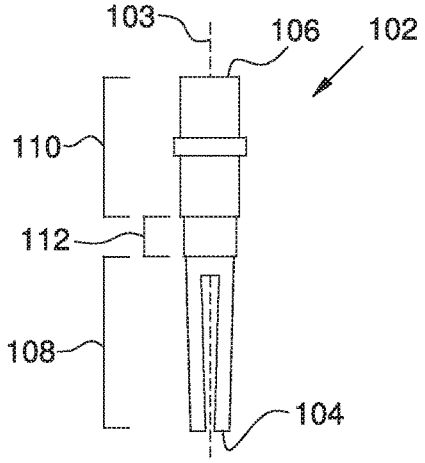
FIG. 1 is a diagrammatic side view of an example embodiment of female electrical contact.

Referring now to the drawings, like reference numerals designate identical or corresponding features throughout the several views.

Embodiments in accordance with the present invention promote improved flow of plating solution through the interior of the article being plated (e.g., cylindrical electrical contact or contact 102). As a result, the systems and methods described herein enable more uniform selective plating of the interior of such articles.

Figure 2:
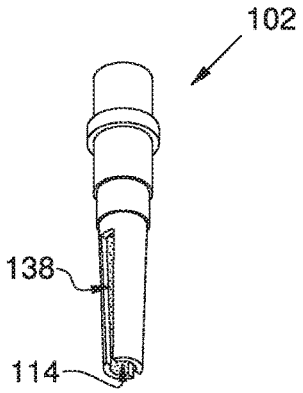
FIG. 2 is a diagrammatic perspective view of the contact shown in FIG. 1.
Figure 3:
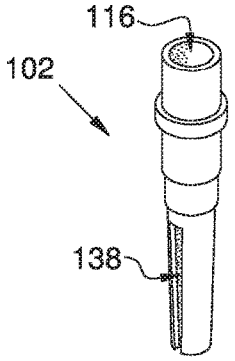
FIG. 3 is a different diagrammatic perspective view of the contact shown in FIG. 1.
Figure 4:
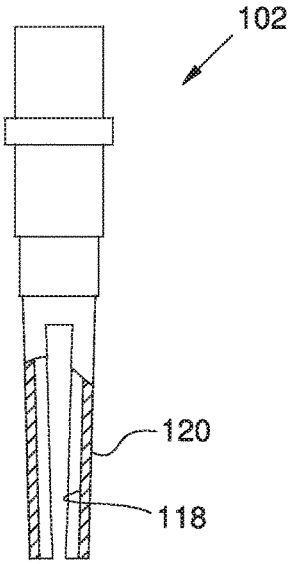
FIG. 4 is a diagrammatic partial cross-sectional view of the female contact shown in FIG. 1, illustrating a portion of the interior and exterior surfaces of the socket portion of the contact.

Referring to FIG. 1, an exemplary female electrical contact (sometimes also referred to as a "connector") 102 may include, for example, a longitudinal axis 103, a first end 104, a second end 106, a socket portion adjacent the first end 104, a cable or wire securement portion 110 adjacent the second end 106, and an intermediate portion 112 disposed between the socket portion 108 and the cable securement portion 110. With reference to FIGS. 2-3, in embodiments of the female electrical contact 102, the cable securement portion 110 will generally include a cable receptacle 116, and the socket portion may feature an exterior surface 120, an elongated lateral opening 138, and an interior surface 118 at least partially defining a pin receptacle 114.

Figure 5:
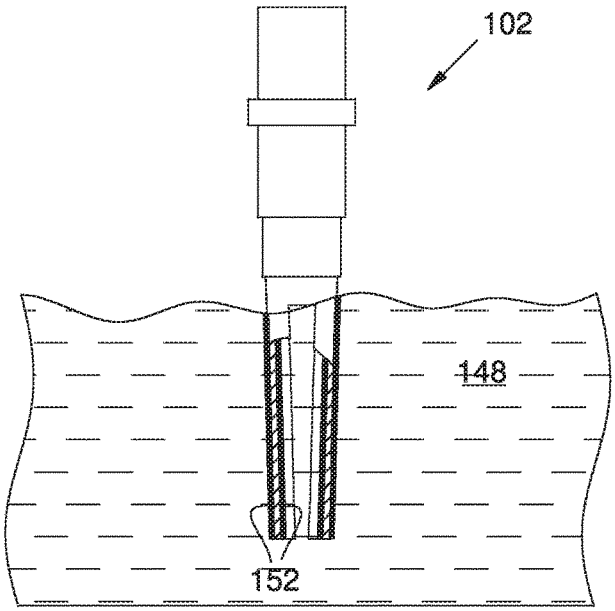
FIG. 5 is a diagrammatic partial cross-sectional view similar to that of FIG. 4, but wherein the contact has been inserted into a bath of plating solution in a conventional manner, resulting in the deposit of plating material on both the interior and exterior surfaces of the socket portion of the contact.

FIG. 5 illustrates what would typically occur as a result of a conventional plating process in which the bare socket portion 108 is inserted into a bath 148 of plating solution (e.g., comprising electrolyte and dissolved metal ions). Plating material 152 forms on the interior surface 118 and exterior surface 120 of socket portion 108.

Figure 6:
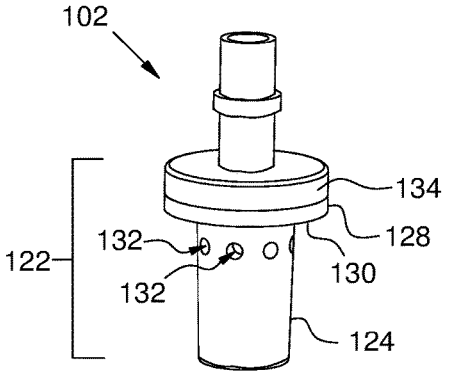
FIG. 6 is a diagrammatic perspective view of one example embodiment of a sleeve subassembly in accordance with the present invention, shown with a female electrical contact inserted therein.
Figure 7:
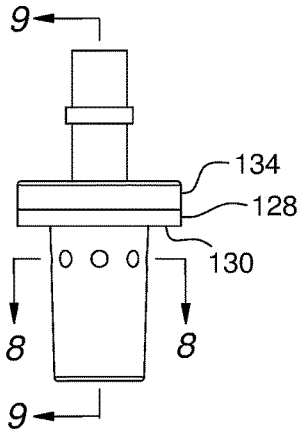
FIG. 7 is a diagrammatic side view of the sleeve subassembly and contact of FIG. 6.
Figure 8:
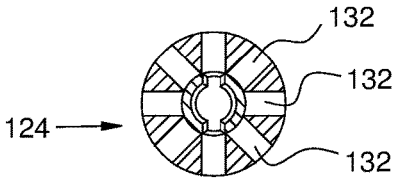
FIG. 8 is a diagrammatic cross-sectional view taken along lines 8-8 in FIG. 7, illustrating the interior surface of the contact being in fluid communication with one or more of a plurality of radial apertures in the respective sleeve element.
Figure 12:
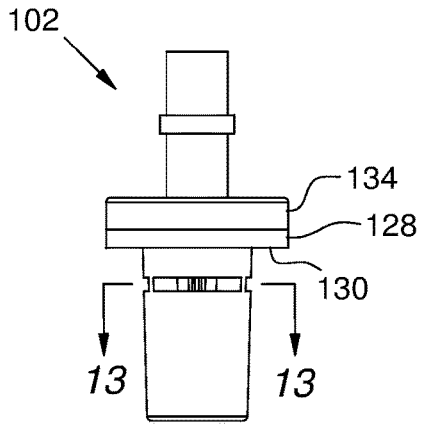
FIG. 12 is a diagrammatic side view of the sleeve subassembly and contact of FIG. 11.
Figure 12A:
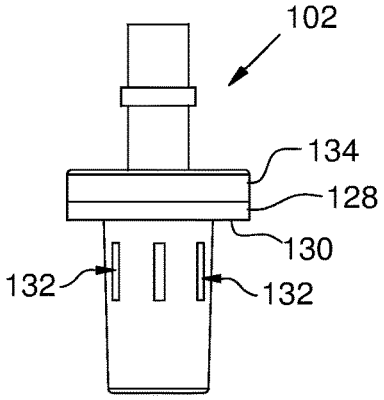
FIG. 12A is a diagrammatic side view similar to that of FIG. 12, but wherein the plurality of the radial apertures are in the form of vertical slits.
Figure 13:
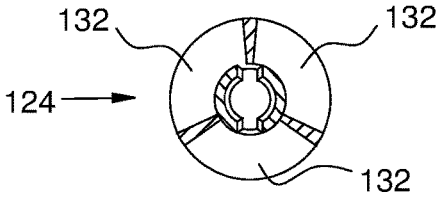
FIG. 13 is a diagrammatic cross-sectional view taken along lines 13-13 in FIG. 12, illustrating the interior surface of the contact being in fluid communication with one or more of a plurality of slit-shaped radial apertures in the respective sleeve element.

Referring to FIGS. 6-8, a sleeve subassembly 122 is shown with a female contact 102 received therethrough. A sleeve subassembly 122 (otherwise more generally referred to herein as a "sleeve") may include a sleeve element 124 (e.g., electrically insulative portion), and a conduction element 134. The conduction element 134 is electrically conductive, and may be a separate component from the sleeve element 124, or may be formed integrally with the sleeve element 124. Sleeve elements 124 may include a main bore 126 and a flange portion 128 which defines a shoulder portion 130. In certain preferred embodiments, the sleeve element 124 includes a plurality of radially-extending apertures 132. Such apertures may have a generally circular cross-section (e.g., by having been drilled), or may alternatively take the form of circumferential slits, as illustrated for example in FIGS. 11-13. As illustrated for example in FIG. 12A, in further alternative, the radially-extending apertures 132 may take the form of vertical slits. The sleeve element 124 serves, at least in part, as a masking mechanism for the plating of the contact 102. Using an increased number of radially-extending apertures or alternatively, circumferential or vertical slits, may facilitate the improved flow of plating solution through the interior of the socket portion 108 of the contact 102, regardless of the rotational orientation of the contact 102 relative to the respective sleeve element 124.

The term "sleeve subassembly" as used herein may refer to an actual assembly of separate components collectively forming a sleeve 122, or it may refer to a unitary component having both electrically conductive and nonconductive (insulative) portions. The conductive portion of the sleeve subassembly (e.g., conductive element 134) may preferably be made of noncorrosive conductive material to facilitate electrical continuity between a power source and the contacts 102 being plated. The insulative portion 124 of the sleeve subassembly 122 may preferably be made out of inert material such as Teflon, Silicon rubber, and the like, to avoid contaminating the plating solutions.

Figure 9:
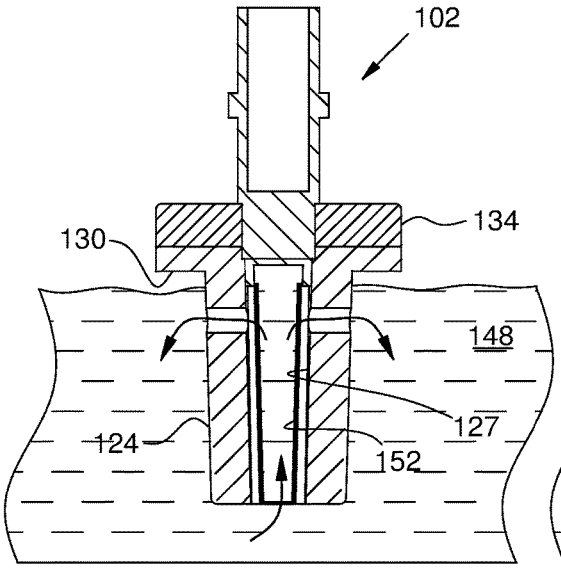
FIG. 9 is a diagrammatic cross-sectional view of an example embodiment of a sleeve subassembly and contact in accordance with the present invention, wherein the sleeve element is at least partially submerged into plating solution, application of plating material is substantially limited to the interior surface of the socket portion of the contact, and the radially-extending apertures allow air to escape and plating solution to flow therethrough.
Figure 10:
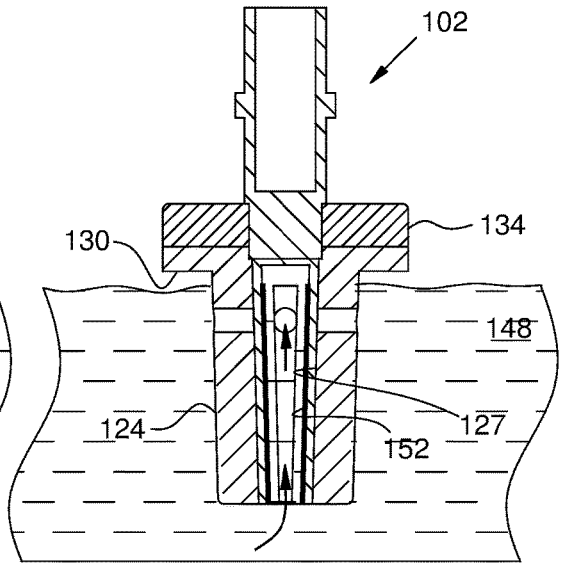
FIG. 10 is a diagrammatic cross-sectional view taken orthogonally to that of FIG. 9, showing the plating solution flowing through the interior of the socket portion of the contact and to at least on radial aperture in the sleeve element.

FIGS. 9 and 10 illustrate a sleeved contact 102 in plating solution 148. The radial apertures 132 facilitate the improved flow of plating solution 148 through the interior of the socket portion 108. The radial apertures 132 facilitate this flow by ensuring that at least one such aperture is in fluid communication with the interior of the socket portion 108 regardless of the rotary orientation of the contact 102 (e.g., the direction of its lateral opening 138).

Figure 14:
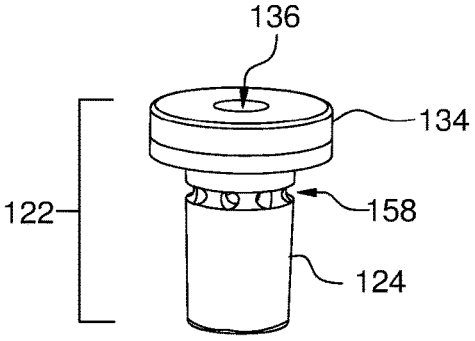
FIG. 14 is a diagrammatic perspective view of a sleeve subassembly similar to that shown in FIG. 6, but wherein the sleeve element includes an annular groove in fluid communication with one or more of the radial apertures.
Figure 15:
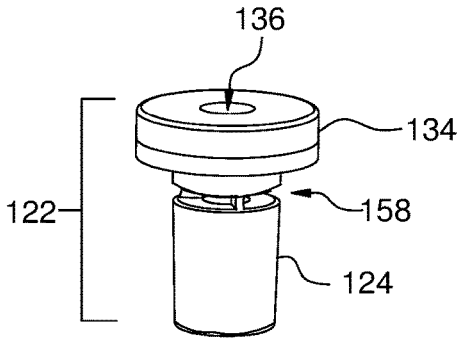
FIG. 15 is a diagrammatic perspective view of a sleeve subassembly similar to that shown in FIG. 12, but wherein the sleeve element includes an annular groove in fluid communication with one or more of the radial apertures.
Figure 16:
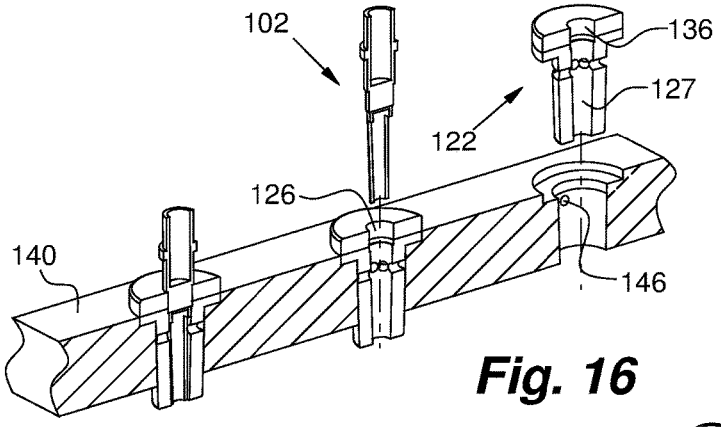
FIG. 16 is a diagrammatic perspective cross-sectional view of a sleeve and contact transport element with sleeve subassemblies and contacts shown in various states of engagement.

Referring to FIGS. 16-19, preferred embodiments may include one or more transport elements 140 (such as a conveyor belt) configured to securely retain a multiplicity of sleeves 122 for movement through plating solution 148. If the transport element is thick enough, it may envelop the radial apertures of the sleeves 122. In such case, the transport element 140 may include fluid relief ports 146 disposed in fluid communication between the radial apertures of the sleeves, and the plating solution located laterally to the transport element 140. Moreover, as illustrated in FIGS. 14 and 15, an annular groove 158 may be provided in the sleeve element 124, to facilitate fluid communication between the radial apertures 132 and the respective fluid relief port 146.

Figure 20:
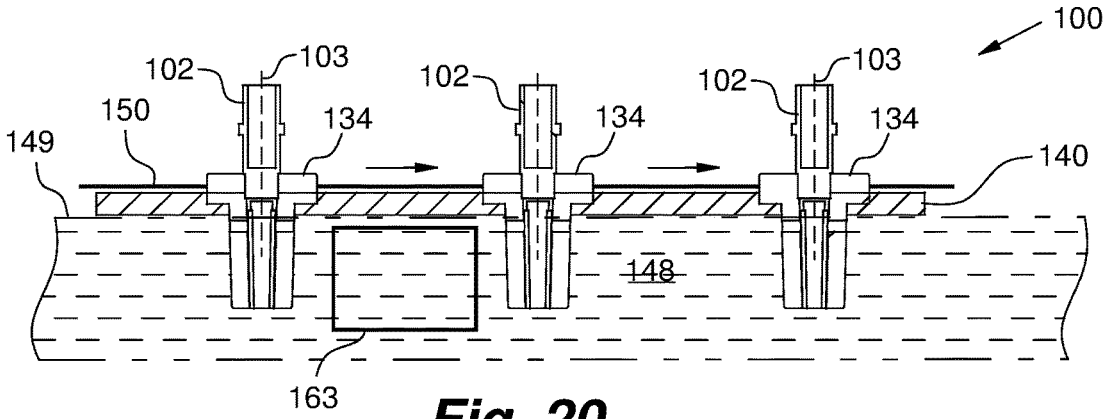
FIG. 20 is a diagrammatic cross-sectional view similar to that of FIG. 18, but wherein the transport element is a vertically thinner embodiment so as not to obstruct or intervene in the flow of plating solution to or from the sleeve radial apertures.
Figure 21:
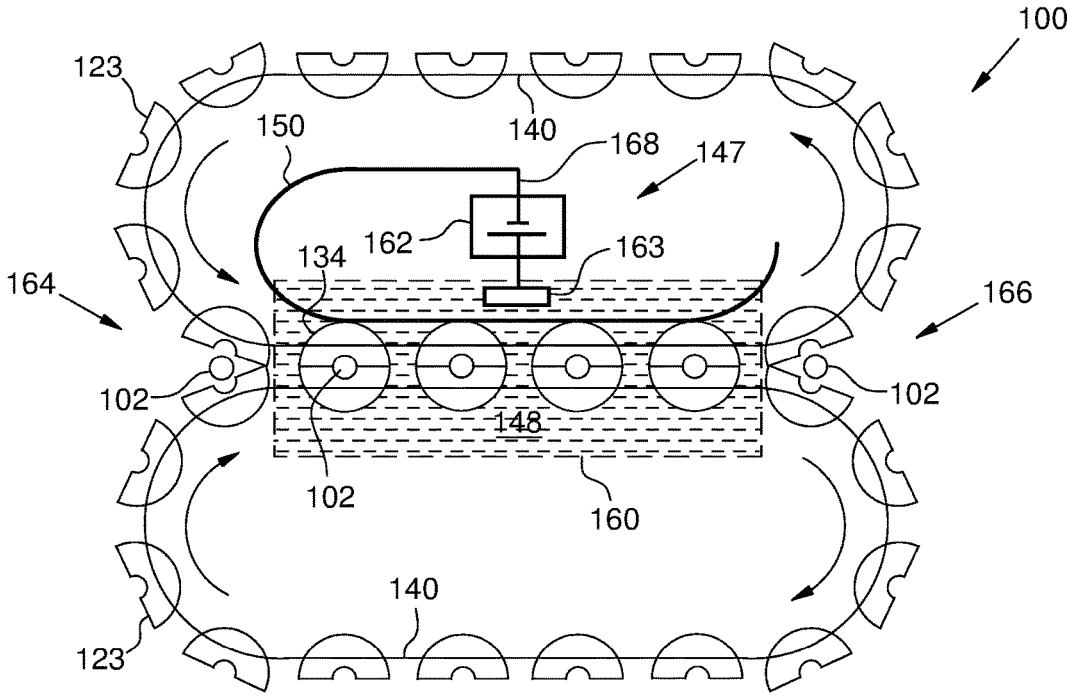
FIG. 21 is a diagrammatic view of an example embodiment of a system in accordance with the present invention, wherein the sleeve subassemblies are each formed of two repeatedly combinable and divisible halves moving along coordinated conveyor portions of the system in order to transport electrical contacts through a plating bath disposed between a contact loading zone and a contact offloading zone.
Figure 22:
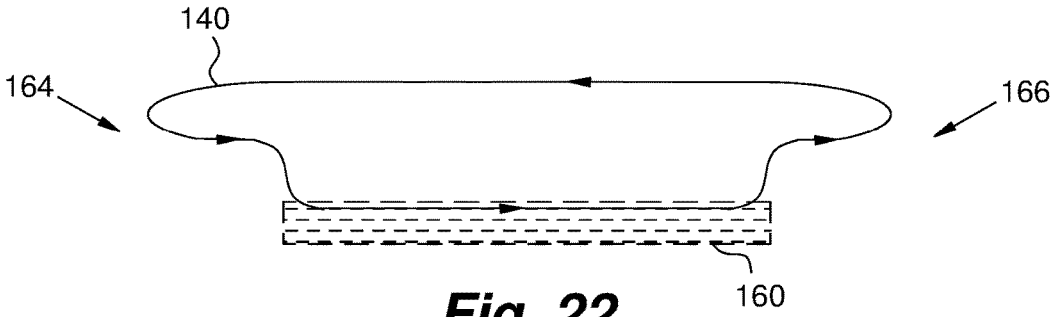
FIG. 22 is a schematic side view of a system similar to that shown in FIG. 21, showing an example path of the transport element in which the sleeve subassemblies and contacts are transported downward to pass through a plating bath and upward to be removed therefrom.

With reference to FIGS. 20-22, in particular embodiments of a system 100 or method for selective electroplating, a multiplicity of half-sleeves 123 may be integrated on a pair of endless (closed loop) transport elements (e.g., belts) 140 in a manner allowing for the efficient selective plating of contacts 102. For example, as the belts 140 move in the directions shown, each contact 102 may be received by a complimentary pair of mutually-engaging half-sleeves 123 in a loading zone 164, transported through the plating bath 160 for selective plating of the interior surface of the contact 102, and released (e.g., discharged) at an offloading zone 166. An electrical supply 162 is preferably placed in direct current-generating communication between the anode 163 of the plating circuit 147 (e.g. the metal to be plated onto the contact 102) and the cathode of the circuit (e.g., the contact 102). In particular embodiments, an electrical contact element (e.g., supply rail) 150 may be electrically conductively disposed between the electrical supply 162 at a cathode side of the circuit 147, and the contact element 102 being plated. In such configuration, the electrical contact element 150 may be configured to slidably electrically engage the conduction element 134 of each respective sleeve subassembly 122 as the sleeve subassemblies move through the plating bath 160. During that time, the respective electric charge is communicated through the conduction element 134 to the respective contact 102 by way of static physical contact therebetween, for example, as a result of a close fit between the intermediate portion 112 of the contact 102 and the conduction bore 136 of the conduction element 134.

One preferred embodiment of a system 100 for selective plating of interiors of elongated articles 102 may comprise a multiplicity of sleeve subassemblies 122, a plating bath 160, and a transport element 140. Each elongated article 102 (such as a female electrical connector/contact) may have a socket portion 108 with an inner surface 118 and an outer surface 120. Each sleeve subassembly 122 may be configured to supportingly receive a respective elongated article 102, and may include an electrically insulative portion 124. Each insulative portion 124 may have a socket bore 127 and least one radial aperture 132 extending radially outward from the socket bore 127. Each socket bore may be configured to maskingly engage the outer surface 120 of the respective elongated article 102, thereby substantially preventing plating solution 148 from contacting the outer surface 120 of the socket portion 108.

Referring to FIGS. 20 and 21 for example illustration, the plating bath 160 is generally configured to contain plating solution 148. The transport element 140 may be configured to transport the sleeve subassemblies 122 across the plating bath 160 whereby at least a segment of the insulative portions 124 become submerged in the plating solution 148, and the plating solution 148 is able to flow along the inner surfaces 118 so as to facilitate selective plating of the inner surface 118 of the socket portion 108.

Figure 11:
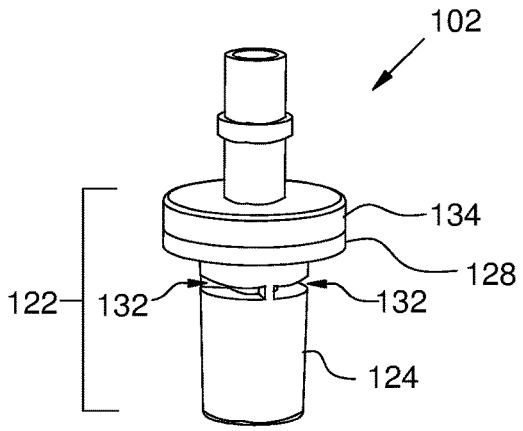
FIG. 11 is a diagrammatic perspective view similar to that of FIG. 6, but wherein the plurality of the radial apertures are in the form of circumferential slits.
Figure 17:
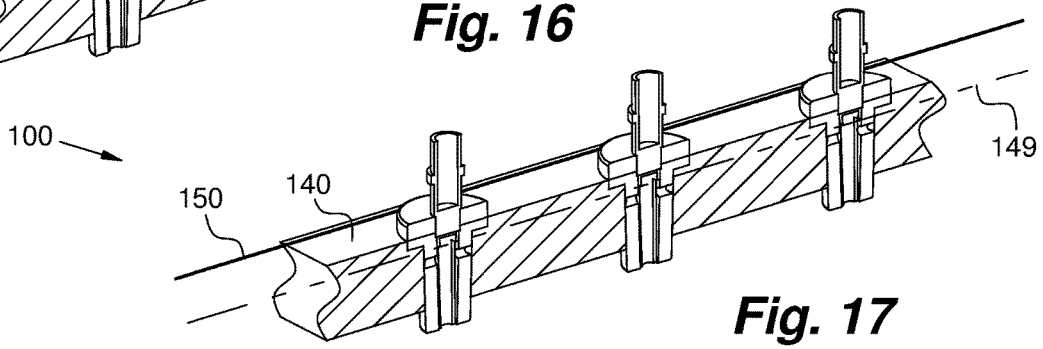
FIG. 17 is a diagrammatic perspective cross-sectional view of an example embodiment of a system in accordance with the present invention.
Figure 18:
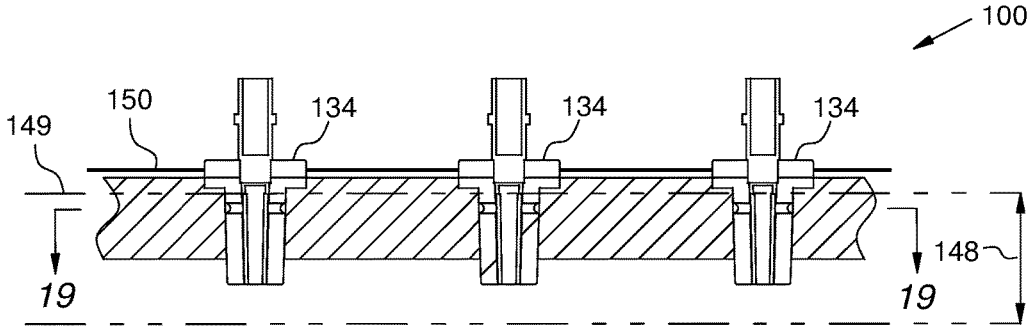
FIG. 18 is a further diagrammatic cross-sectional view of the embodiment of FIG. 17.

With reference to FIGS. 10, 11 and 17, each sleeve subassembly 122 may further include a conductive portion 134 configured to be in electrically conductive communication with the respective elongated article 102. With reference to FIGS. 20 and 21, the system 100 may further comprise an electroplating circuit 147 including a power supply 162, a cathode side 168 and an anode 163. The anode 163 would generally be disposed in the plating solution 148. An electrical contact element 150 (e.g., a conductive rail) may be disposed in electrical communication with the cathode side 168 and configured to slidably electrically engage the conductive portions 134 during the aforementioned transport of the sleeve assemblies across the plating bath 160. Each conductive portion 134 may be annularly-shaped and includes a conduction bore 136 for receiving an intermediate portion of the respective elongated article 102, thereby facilitating electrically conductive communication with the respective elongated article.

With reference to FIGS. 6, 9 and 10, in particular embodiments of the system 100, when an elongated article 102 is supportingly received by a sleeve subassembly 122, at least one respective radial aperture 132 would be disposed in fluid communication with the inner surface 118 of the respective socket portion 108.

The insulative portions 124 of the sleeve subassembly 122 may preferably comprise a chemically inert material, such as Teflon, Silicon rubber or the like. Moreover, with reference to FIGS. 6 and 8 for example, the insulative portions 124 may include a multiplicity of radial apertures 132. One or more such radial apertures 132 may be in the form of horizontal or vertical slits, as shown for example in FIGS. 11 and 12A. With reference to FIGS. 9 and 10, the radial apertures 132 may be configured (e.g., positioned) so as to be at least partially submerged in the plating solution 148 during transport across the plating bath so that plating solution may flow through them.

Each insulative portion 124 may include a radially-extending flange portion 128. With reference to FIG. 2, each socket portion 108 may include a longitudinal slot 138 extending therethrough. Referring to FIGS. 9 and 10, the longitudinal slot 138 may be in fluid communication between the respective inner surface 118 and at least one radial aperture 132.

Figure 19:
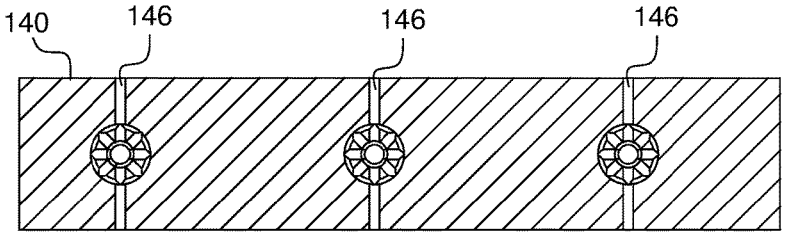
FIG. 19 is a diagrammatic cross-sectional view taken along lines 19-19 in FIG. 18, showing respective annular grooves in fluid communication between sleeve radial apertures and fluid relief ports in the transport element.

Referring to FIGS. 16-19, in particular embodiments of a system 100, the transport element 140 may be at least partially submerged in the plating solution 148 such that some of the plating solution 148 is disposed laterally of the transport element 140. Referring to FIG. 19 in particular, in such embodiments, the transport element 140 may include fluid relief ports 146 disposed in fluid communication between the radial apertures 132 and the laterally-disposed plating solution.

Referring to FIG. 21, in certain embodiments of a system 100, the sleeve subassembly 122 may comprise a complimentary pair of mutually engageable half-sleeves 123. In such embodiments, the transport element 140 may include two transport portions (e.g., closed-loop conveyer belts), each transport portion 140 being configured to transport one of each the pair of half-sleeves 123 (i) into mutual engagement with its complimentary half-sleeve, (ii) across the plating bath, and (iii) out of mutual engagement with its complimentary half-sleeve.

Figure 23:
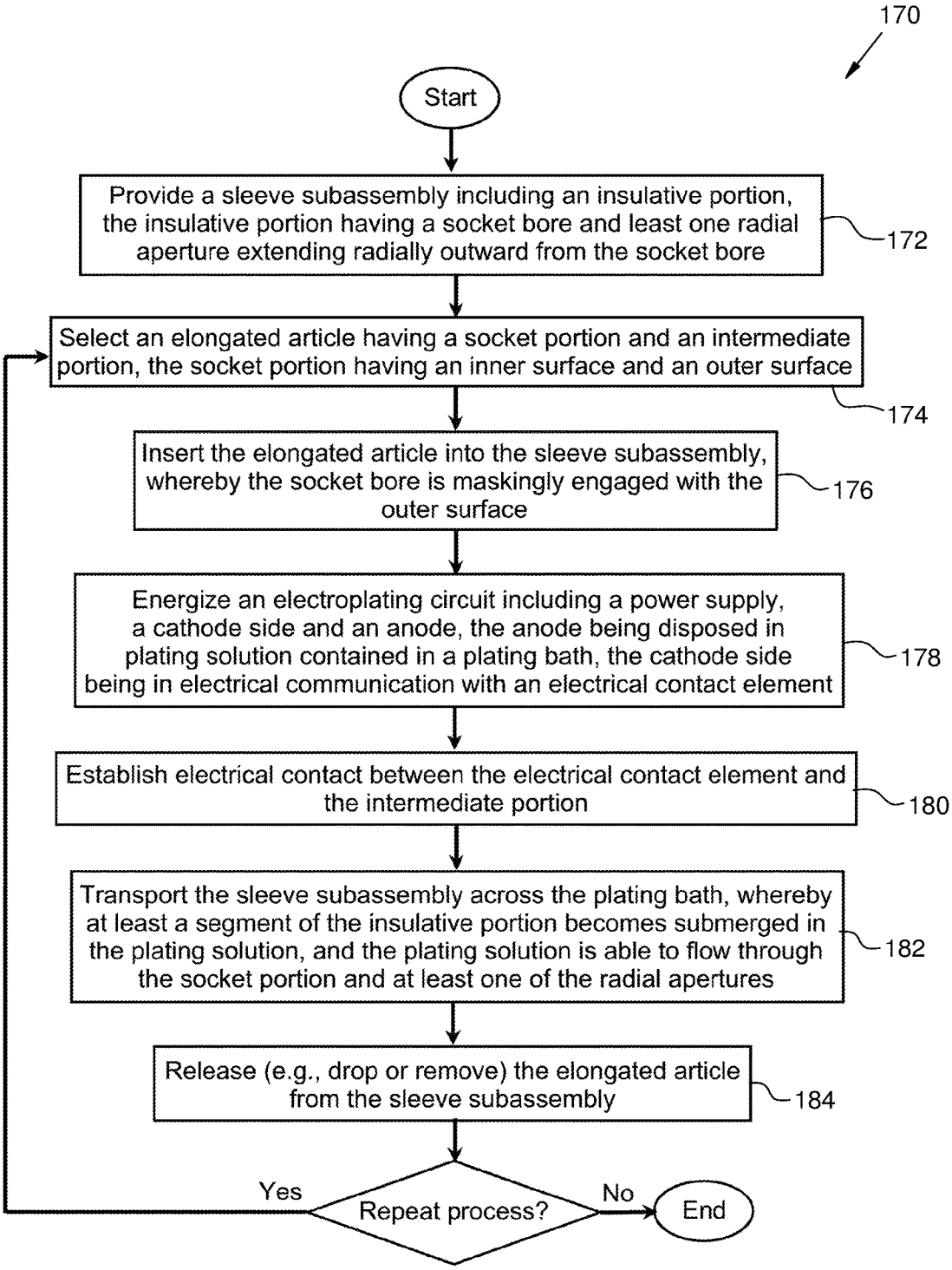
FIG. 23 is a diagrammatic flow chart depicting one example embodiment of a method for selective plating of interiors of elongated articles in accordance with the present invention.

With reference to FIG. 23, a preferred embodiment of a method 170 for selective plating of interiors of elongated articles may comprise one or more of the following steps. At block 172, a sleeve subassembly 122 is provided which may include an electrically insulative portion 124, the insulative portion having a socket bore 127 and least one radial aperture 132 extending radially outward from the socket bore 127. At block 174, an elongated article 102 is selected which may have a socket portion 108 and an intermediate portion 112, the socket portion 108 having an inner surface 118 and an outer surface 120. At block 176, the elongated article 102 is inserted into the sleeve subassembly 122, whereby the socket bore 127 is maskingly engaged with the outer surface 120. At block 178, an electroplating circuit 147 including a power supply 162, a cathode side 168 and an anode 163 is energized. The anode 163 is generally disposed in plating solution 148 contained in a plating bath 160. The cathode side 168 is in electrical communication with an electrical contact element 150. At block 180, electrical contact (communication) is established between the electrical contact element 150 and the elongated article 102, typically at the intermediate portion 112. At block 182, the sleeve subassembly 122 (with the elongated article 102 therein) is transported across the plating bath 160, whereby at least a segment of the insulative portion 124 becomes submerged in the plating solution 148, and the plating solution 148 is able to flow through the socket portion 108 and, in certain embodiments, at least one radial aperture 132. At block 184, the now-plated elongated article 102 may be released from the sleeve subassembly 122.

In preferred embodiments of a method for selective plating of interiors of elongated articles, the sleeve subassembly 122 may further include a conductive portion 134. In such embodiments, in the step of inserting, the conductive portion 134 comes into electrically conductive communication with the intermediate portion 112, and the electrical contact between the electrical contact element 150 and the elongated article 102 is by way of this conductive portion 134.

With reference to FIG. 21, in certain preferred embodiments of a method for selective plating of interiors of elongated articles, the sleeve subassembly 122 may comprise a complimentary pair of mutually engageable half-sleeves 123. In such embodiments, the step of transporting 182 may be performed by way of a transport element including two transport portions, each transport portion 140 being configured to transport a half-sleeve 123 (i) into mutual engagement with its complimentary half-sleeve, (ii) across the plating bath 160, and (iii) out of mutual engagement with its complimentary half-sleeve 123.

As illustrated for example, in FIG. 22, in a system 100 or method for selective electroplating, the transport element 140 may transport the sleeves 122 and contacts 102 in descending fashion downward into the plating bath 160 proximate loading zone 164. FIG. 20 illustrates, by way of one example embodiment, the respective position of the upper level 149 of the plating solution 148 while the sleeve 122 and contacts 102 are transported through the plating bath 160. Returning to FIG. 22, once the plating is complete, the transport element 140 may transport the respective sleeves 122 and contacts 102 in ascending fashion upward from the plating bath 160 proximate the offloading zone 166.

Systems and methods in accordance with the present invention allow cost-effective and uniform selective plating of the interior of cylindrical electrical contacts such as "sockets." Unrestricted or less-restricted flow of plating solution through the interior of the article (e.g., electrical contact) is promoted while minimizing or restricting access of plating solution to the exterior of the article.

While a negligible amount of plating may occur on the exterior of the contact 102, for example, due to the plurality of small radial apertures 132 not being aligned with the longitudinal slot 138 of the contact 102, a significant saving of plating material such as gold may be realized.

Embodiments in accordance with the present invention may include one or more of the following advantages, features and/or processes: (a) selective plating of interiors of cylindrical articles, such as electrical screw machine contacts by using sleeves as masking apparatus; (b) the sleeve insulative portion 124 may have a plurality of slits, radially drilled holes, or the like, allowing unrestricted flow of air and/or plating solution therethough; (c) the sleeve insulative portion 124 design may have the above slots or perforations positioned, e.g., vertically, to meet specific plating length (depth) requirements; (d) the sleeve subassembly 122 design may allow its upper part (e.g., conduction element) to be electrically conductive while its lower part which is in contact with plating solution is nonconductive (insulative); (e) the electrically insulative portion(s) of the sleeve subassemblies may be made out of inert materials such as Teflon, Silicon rubber, etc. so as not to contaminate plating solution; (f) components of the sleeve subassemblies 122 may be modular and exchangeable to facilitate various plating needs and requirements (g) sleeve subassemblies or portions thereof may be reusable or recyclable; (h) the conductive portion of the sleeve subassembly may be made of noncorrosive conductive material to facilitate extended and durable electrical continuity to power source; (i) the elongated articles (e.g., electrical contact) may be easily inserted into a sleeve subassembly prior to plating and extracted after plating; (j) half-sleeves may be attached to or formed integrally with a moving conveyor belt to allow easy contact loading and contact separation (e.g., release or discharge of the elongated article after the additive plating); (k) sleeve form factor may closely or exactly match the specific dimensions of the elongated article (e.g., screw machine contact) retained therein.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for selective plating of interiors of elongated articles, each elongated article having a socket portion with an inner surface and an outer surface, the system comprising:

a multiplicity of sleeve subassemblies, each said sleeve subassembly being configured to supportingly receive a respective said elongated article, each said sleeve subassembly including an electrically insulative portion, each said insulative portion having a socket bore and least one radial aperture extending radially outward from said socket bore, each socket bore being configured to maskingly engage said outer surface of the respective said elongated article;

a plating bath configured to contain plating solution; and a transport element configured to transport the sleeve subassemblies across said plating bath whereby at least a segment of the insulative portions become submerged in said plating solution, and said plating solution is able to flow along said inner surfaces;

wherein (a) said transport element is at least partially submerged in the plating solution such that some of the plating solution is disposed laterally of said transport element, and (b) said transport element includes fluid relief ports disposed in fluid communication between said radial apertures and said laterally-disposed plating solution.

2. A system as defined in claim 1 in which each said sleeve subassembly further includes a conductive portion configured to be in electrically conductive communication with the respective said elongated article.

3. A system as defined in claim 2 further comprising (a) an electroplating circuit including a power supply, a cathode side and an anode, said anode being disposed in said plating solution; and (b) an electrical contact element in electrical communication with said cathode side and configured to slidably electrically engage the conductive portions during said transport.

4. A system as defined in claim 2 in which each said conductive portion is annularly-shaped and includes a conduction bore for receiving an intermediate portion of the respective said elongated article, thereby facilitating said electrically conductive communication with the respective said elongated article.

5. A system as defined in claim 1 in which, when a said elongated article is supportingly received by a said sleeve subassembly, at least one respective said radial aperture is in fluid communication with the inner surface of the respective socket portion.

6. A system as defined in claim 1 in which said insulative portions comprise a chemically inert material.

7. A system as defined in claim 1 in which each said insulative portion includes a multiplicity of said radial apertures.

8. A system as defined in claim 1 in which each insulative portion includes a radially-extending flange portion.

9. A system as defined in claim 1 in which the at least one said radial aperture is a slit.

10. A system as defined in claim 1 in which said radial apertures are submerged in said plating solution during said transport.

11. A system as defined in claim 1 in which each said socket portion includes a longitudinal slot extending therethrough, said longitudinal slot being in fluid communication between the respective said inner surface and at least one said radial aperture.

12. A system for selective plating of interiors of elongated articles, each elongated article having a socket portion with an inner surface and an outer surface, the system comprising:

a multiplicity of sleeve subassemblies, each said sleeve subassembly being configured to supportingly receive a respective said elongated article, each said sleeve subassembly including an electrically insulative portion, each said insulative portion having a socket bore and least one radial aperture extending radially outward from said socket bore, each socket bore being configured to maskingly engage said outer surface of the respective said elongated article;

a plating bath configured to contain plating solution; and a transport element configured to transport the sleeve subassemblies across said plating bath whereby at least a segment of the insulative portions become submerged in said plating solution, and said plating solution is able to flow along said inner surfaces;

wherein (a) each said sleeve subassembly comprises a complimentary pair of mutually engageable half-sleeves, and (b) said transport element includes two transport portions, each said transport portion being configured to transport one of each said pair of half-sleeves (i) into mutual engagement with its complimentary half-sleeve, (ii) across said plating bath, and (iii) out of mutual engagement with its complimentary half-sleeve.

* * * * *